US009920484B2

(12) United States Patent
Marcoccia et al.

(10) Patent No.: US 9,920,484 B2
(45) Date of Patent: Mar. 20, 2018

(54) SURFACE ENHANCED PULP FIBERS AT A SUBSTRATE SURFACE

(71) Applicant: Domtar Paper Company, LLC, Fort Mill, SC (US)

(72) Inventors: Bruno Marcoccia, Charlotte, NC (US); Harshad Pande, Pointe-Claire (CA); Robert M. Williams, Woodsfield, OH (US)

(73) Assignee: DOMTAR PAPER COMPANY, LLC, Fort Mill, SC (US)

( * ) Notice: Subject to any disclaimer, the term of this patent is extended or adjusted under 35 U.S.C. 154(b) by 0 days.

(21) Appl. No.: 15/120,220

(22) PCT Filed: Feb. 20, 2015

(86) PCT No.: PCT/US2015/016865

§ 371 (c)(1),
(2) Date: Aug. 19, 2016

(87) PCT Pub. No.: WO2015/127239

PCT Pub. Date: Aug. 27, 2015

(65) Prior Publication Data

US 2017/0058457 A1 Mar. 2, 2017

Related U.S. Application Data

(60) Provisional application No. 61/942,694, filed on Feb. 21, 2014.

(51) Int. Cl.

| | |
|---|---|
| ***D21H 11/16*** | (2006.01) |
| ***D21H 19/54*** | (2006.01) |
| ***D21H 15/02*** | (2006.01) |
| ***D21H 17/25*** | (2006.01) |
| ***D21H 17/28*** | (2006.01) |
| ***D21H 17/00*** | (2006.01) |
| ***D21H 21/28*** | (2006.01) |
| ***D21H 21/52*** | (2006.01) |
| ***D21H 11/02*** | (2006.01) |

(52) U.S. Cl.

CPC ..... *D21H 19/54* (2013.01); *D21H 11/02* (2013.01); *D21H 11/16* (2013.01); *D21H 15/02* (2013.01); *D21H 17/25* (2013.01); *D21H 17/28* (2013.01); *D21H 17/72* (2013.01); *D21H 21/28* (2013.01); *D21H 21/52* (2013.01)

(58) Field of Classification Search

CPC ..... D21H 11/16; D21H 11/02; D21H 15/02; D21H 17/25; D21H 17/28; D21H 17/72; D21H 19/54; D21H 21/28; D21H 21/52

USPC ..... 162/175

See application file for complete search history.

(56) References Cited

U.S. PATENT DOCUMENTS

| | | | |
|---|---|---|---|
| 3,098,785 | A | 7/1963 | Meiler |
| 3,388,037 | A | 6/1968 | Asplund |
| 3,794,558 | A | 2/1974 | Back |
| 4,012,279 | A | 3/1977 | Selander |
| 4,635,864 | A | 1/1987 | Peterson |
| 5,695,136 | A | 12/1997 | Rohden |
| 5,731,080 | A | 3/1998 | Cousin et al. |
| 5,954,283 | A | 9/1999 | Matthew |
| 6,156,118 | A | 12/2000 | Silenius et al. |
| 6,251,222 | B1 | 6/2001 | Silenius et al. |
| 6,375,974 | B1 | 4/2002 | Ito et al. |
| 6,599,391 | B2 | 7/2003 | Silenius et al. |
| 6,773,552 | B1 | 8/2004 | Albert et al. |
| 6,861,380 | B2 | 3/2005 | Garnier et al. |
| 6,887,350 | B2 | 5/2005 | Garnier et al. |
| 6,935,589 | B1 | 8/2005 | Matthew |
| 7,381,294 | B2 | 6/2008 | Suzuki et al. |
| 7,624,879 | B2 | 12/2009 | Frances |
| 7,741,234 | B2 | 6/2010 | Smith |

(Continued)

FOREIGN PATENT DOCUMENTS

| | | |
|---|---|---|
| AU | 2015218812 | 7/2017 |
| AU | 2013305802 | 8/2017 |

(Continued)

OTHER PUBLICATIONS

Pande, Harshad; Applicant Initiated Interview Summary for U.S. Appl. No. 13/836,760, filed Mar. 15, 2013, dated May 9, 2017, 3 pgs.

Domtar Paper Company, LLC; Notice of Acceptance for Australian application No. 2013305802, filed Feb. 23, 2015, dated Apr. 21, 2017, 3 pgs.

Domtar Paper Company, LLC; Notice of Acceptance for New Zealand application No. 705191, filed Aug. 21, 2013, dated Apr. 13, 2017.

(Continued)

*Primary Examiner* — Mark Halpern

(74) *Attorney, Agent, or Firm* — Norton Rose Fulbright US LLP

(57) ABSTRACT

The present invention relates to a method of making a paper product having improved printing characteristics. This is achieved by forming a fibrous substrate, and applying a surface treatment which comprises an aqueous composition. Notably, the aqueous composition includes surface enhanced pulp fibers, with the placement of the surface enhanced pulp fibers optimizing their functionality, with surface placement by use of a paper machine size press desirably facilitating a reduction in the typical starch usage. The present method comprising the steps of providing a aqueous slurry comprising a blend of cellulosic fibers and water and dewatering the aqueous slurry of cellulosic fibers and water to form a fibrous substrate. The present method further includes applying a surface treatment to the fibrous substrate, wherein the surface treatment comprises an aqueous composition including surface enhanced pulp fibers, to form a treated fibrous substrate, and thereafter drying the treated fibrous substrate to form a paper product having enhanced printing characteristics.

23 Claims, 2 Drawing Sheets

(56) References Cited

U.S. PATENT DOCUMENTS

| | | | |
|---|---|---|---|
| 7,942,964 | B2 | 5/2011 | Luo et al. |
| 2002/0059886 | A1 | 5/2002 | Merkley et al. |
| 2002/0069791 | A1 | 6/2002 | Merkley et al. |
| 2004/0180184 | A1 | 9/2004 | Fillion |
| 2004/0241350 | A1 | 12/2004 | Koga et al. |
| 2006/0006264 | A1 | 1/2006 | Sabourin |
| 2007/0164143 | A1 | 7/2007 | Sabourin et al. |
| 2008/0148999 | A1 | 6/2008 | Luo et al. |
| 2009/0145562 | A1 | 6/2009 | Nguyen |
| 2009/0162602 | A1 | 6/2009 | Cottier et al. |
| 2010/0218908 | A1 | 9/2010 | Silenius et al. |
| 2010/0288456 | A1 | 11/2010 | Westland et al. |
| 2011/0277947 | A1 | 11/2011 | Hua et al. |
| 2012/0007363 | A1 | 1/2012 | Wang |
| 2013/0202870 | A1 | 8/2013 | Malmborg et al. |
| 2014/0057105 | A1 | 2/2014 | Pande et al. |
| 2016/0333524 | A1 | 11/2016 | Pande |
| 2016/0340802 | A1 | 11/2016 | Pande |
| 2017/0226009 | A1 | 8/2017 | Marcoccia et al. |

FOREIGN PATENT DOCUMENTS

| | | |
|---|---|---|
| CA | 2883161 | 3/2017 |
| CN | 1718914 | 1/2006 |
| CN | 101691700 | 4/2010 |
| JP | H02229747 | 9/1990 |
| JP | H03122038 | 5/1991 |
| JP | H04194097 | 7/1992 |
| JP | H07165456 | 6/1995 |
| JP | H08197836 | 8/1996 |
| JP | H08284090 | 10/1996 |
| JP | 2002194691 | 7/2002 |
| JP | 2004525284 | 8/2004 |
| JP | 2004360088 | 12/2004 |
| JP | 2007231438 | 9/2007 |
| JP | 2010125694 | 6/2010 |
| JP | 2012526923 | 11/2012 |
| JP | 2015526608 | 9/2015 |
| KR | 1020050086850 | 8/2005 |
| KR | 1020130132381 | 12/2013 |
| WO | 02095129 | 11/2002 |
| WO | 2012007363 | 1/2012 |
| WO | 2014031737 | 2/2014 |
| WO | 2015127233 | 8/2015 |
| WO | 2015127239 | 8/2015 |

OTHER PUBLICATIONS

Handbook of Pulping and Papermaking, C. Biermann, Academic Press; 2nd Edition (Aug. 5, 1996), p. 145.

Pande, Harshad; Final Office Action for U.S. Appl. No. 13/836,760, filed Mar. 15, 2013, dated May 12, 2016, 10 pgs.

Pande, Harshad; Non-Final Office Action for U.S. Appl. No. 13/836,760, filed Mar. 15, 2013, dated Oct. 15, 2015, 10 pgs.

Pande, Harshad; Restriction Requirement for U.S. Appl. No. 13/836,760, dated Mar. 15, 2013, dated Jul. 16, 2015, 8 pgs.

Teixeira. Article entitled: "Recycled Old Corrugated Container Fibers for Wood-Fiber Cement Sheets"; International Scholarly Research Network 2012(923413): 1-8, 2012, 9 pgs.

Pal, et al., "A Simple Method for Calculation of the Permeability Coefficient of Porous Media". Tappia Journal, 5 (9):10-16.

La Vrykova-Marrain et al., Article entitled: "Characterizing the drainage resistance of pulp and microfibrillar suspensions using hydrodynamic flow measurements", TAPPI's PaperCon 2012 Conference, 38 pgs.

Pande, Harshad; International Search Report and Written Opinion for PCT/US2013/055971, filed Aug. 21, 2013, dated Oct. 14, 2013, 9 pgs.

Marcoccia, Bruno; U.S. Patent Application entitled: Surface Enhanced Pulp Fibers at a Substrate Surface, having U.S. Appl. No. 62/369,362, filed Aug. 1, 2016, 23 pgs.

Pande, Harshad; International Preliminary Report on Patentability for PCR/US2013/055971, filed Aug. 21, 2013, dated Feb. 24, 2015, 7 pgs.

Marcoccia, Bruno; U.S. Provisional Application entitled: Surface Enhanced Pulp Fibers at the Substrate Surface: Solutions, Methods of Application and Enhanced Properties , having U.S. Appl. No. 61/942,694, filed Feb. 21, 2014, 60 pgs.

Marcoccia, Bruno; U.S. Provisional Application entitled: Surface Enhanced Pulp Fibers in Fiber Cement , having U.S. Appl. No. 61/942,708, filed Feb. 21, 2014, 58 pgs.

Marcoccia, Bruno; International Preliminary Report on Patentability for PCT Application No. PCT/US2015/016865, filed Feb. 20, 2015, dated Aug. 23, 2016, 7 pgs.

Marcoccia, Bruno; International Search Report and Written Opinion for PCT Application No. PCT/US2015/016865, filed Feb. 20, 2015, dated May 20, 2015, 8 pgs.

Marcoccia, Bruno; U.S. Provisional Application entitled: Surface Enhanced Pulp Fibers, Methods of Making Surface Enhanced Pulp Fibers, Products Incorporating Surface Enhanced Pulp Fibers, and Methods of Making Products Incorporating Surface Enhanced Pulp Fibers, having U.S. Appl. No. 61/692,880, filed Aug. 24, 2012, 23 pgs.

Marcoccia, Bruno; International Preliminary Report on Patentability for PCT Application No. PCT/US2015/016858, filed Feb. 20, 2015, dated Aug. 23, 2016, 8 pgs.

Marcoccia, Bruno; U.S. Provisional Application entitled: Improved Composition of Lignin and Surface—Enhanced Pulp Fiber, having U.S. Appl. No. 62/189,569, filed Jul. 7, 2015, 5 pgs.

Marcoccia, Bruno; International Search Report and Written Opinion for PCT Application No. PCT/US2015/016858, filed Feb. 20, 2015, dated May 15, 2015, 9 pgs.

Pande, Harshed; Final Office Action for U.S. Appl. No. 13/836,760, filed Mar. 15, 2013, dated Jan. 27, 2017, 16 pgs.

Pande, Harshad; Notice of Allowance for Canadian Patent Application No. 2,883,161, filed Aug. 21, 2013, dated Jan. 3, 2017, 1 pg.

Pande, Harshad; Intention to grant for European patent application No. 13759601.1, filed Aug. 21, 2013, dated Jul. 25, 2017, 45 pgs.

Pande, Harshad; Applicant Initiated Interview Summary for U.S. Appl. No. 13/836,760, filed Mar. 15, 2013, dated Sep. 27, 2017, 3 pgs.

Tonoli, et al.; Article entitled: "Effect of fibre morphology on flocculation of fibre-cement suspensions", Cement and Concrete Research 39 (2009) 1017-1022, published on Nov. 1, 2009, 6 pgs.

Marcoccia, Bruno; International Search Report and the Written Opinion for PCT Application No. PCT/US17/44881, filed Aug. 1, 2017, dated Oct. 18, 2017, 9 pgs.

SURFACE ENHANCED PULP FIBERS AT A SUBSTRATE SURFACE

This application is a 371 of PCT/US15/16865 filed 20 Feb. 2015.

CROSS-REFERENCE TO RELATED APPLICATION

This application is a U.S. National Stage application of International PCT Application No. PCT/US2015/016865, filed Feb. 20, 2015, which claims the benefit of U.S. Provisional Application No. 61/942,694, filed on Feb. 21, 2014.

FIELD OF THE INVENTION

The present invention relates generally to the use of surface enhanced pulp fibers on the surface of a fiber substrate. The present invention relates to various solutions containing surface enhanced pulp fibers, the methods of application of and products incorporating such a surface application. The invention contemplates the placement of surface enhanced pulp fibers on the substrate fiber structure surface where it is optimally functional. The particularly contemplates the use of surface enhanced pulp fibers applied at the surface of printing papers via a paper machine size press in order to reduce starch usage.

BACKGROUND

For many printing and writing grades of paper, a starch solution is applied to the paper surface to enhance the surface strength for end-use applications such as various types of printing. The starch is normally applied at the wet-end (internal sizing) of the paper machine operations and at the size press (external sizing) on the paper machine. The type and amount of starch applied can impact the physical-chemical properties of the paper and the properties of the ultimate end paper product. Thus, a part of the cost of paper manufacturer is related to the cost of the size press starch.

A key property of highly fibrillated surface enhanced pulp fibers is their ability to significantly increase fiber bonding. In this case, the desire is to utilize the strength enhancing and fiber coverage properties of the surface enhanced pulp fibers specifically on the paper surface. The resulting strength increase could then potentially allow a reduction in the amount of starch required while maintaining surface chemistry properties and surface strength. The reduced usage of size press starch would result in a significant cost savings. In the extreme case, an optimal amount of surface enhanced pulp fibers and a minimal amount of starch would be applied to the paper surface with all end use properties maintained.

Pulp fibers, such as wood pulp fibers, are used in a variety of products including, for example, pulp, paper, paperboard, biofiber composites (e.g., fiber cement board, fiber reinforced plastics, etc.), absorbent products (e.g., fluff pulp, hydrogels, etc.), specialty chemicals derived from cellulose (e.g., cellulose acetate, carboxymethyl cellulose (CMC), etc.), and other products. The pulp fibers can be obtained from a variety of wood types including hardwoods (e.g., oak, gum, maple, poplar, eucalyptus, aspen, birch, etc.), softwoods (e.g., spruce, pine, fir, hemlock, southern pine, redwood, etc.), and non-woods (e.g., kenaf, hemp, straws, bagasse, etc.). The properties of the pulp fibers can impact the properties of the ultimate end product, such as paper, the properties of intermediate products, and the performance of the manufacturing processes used to make the products (e.g., papermachine productivity and cost of manufacturing). The pulp fibers can be processed in a number of ways to achieve different properties. In some existing processes, some pulp fibers are refined prior to incorporation into an end product. Depending on the refining conditions, the refining process can cause significant reductions in length of the fibers, can generate, for certain applications, undesirable amounts of fines, and can otherwise impact the fibers in a manner that can adversely affect the end product, an intermediate product, and/or the manufacturing process. For example, the generation of fines can be disadvantageous in some applications because fines can slow drainage, increase water retention, and increase wet-end chemical consumption in papermaking which may be undesirable in some processes and applications.

Fibers in wood pulp typically have a length weighted average fiber length ranging between 0.5 and 3.0 millimeters prior to processing into pulp, paper, paperboard, biofiber composites (e.g., fiber cement board, fiber reinforced plastics, etc.), absorbent products (e.g., fluff pulps, hydrogels, etc.), specialty chemicals derived from cellulose (e.g., cellulose acetate, carboxymethyl cellulose (CMC), etc.) and similar products. Refining and other processing steps can shorten the length of the pulp fibers. In conventional refining techniques, fibers are passed usually only once, but generally no more than 2-3 times, through a refiner using a relatively low energy (for example, about 20-80 kWh/ton for hardwood fibers) and using a specific edge load of about 0.4-0.8 Ws/m for hardwood fibers to produce typical fine paper.

SUMMARY OF THE INVENTION

The present invention relates to a method of making a paper product having acceptable/improved printing characteristics with lower starch amounts at the size press. This is achieved form a fibrous substrate, and applying a surface treatment which comprises an aqueous composition. Notably, the aqueous composition includes surface enhanced pulp fibers, with the placement of the surface enhanced pulp fibers optimizing their functionality, with surface placement by use of a paper machine size press desirably facilitating a reduction in the typical starch usage.

In accordance with the present invention, a method of making a paper product having acceptable/improved printing characteristics, comprising the steps of providing a aqueous slurry comprising a blend of cellulosic fibers and water and dewatering the aqueous slurry of cellulosic fibers and water to form a fibrous substrate.

The present method further includes applying a surface treatment to the fibrous substrate, wherein the surface treatment comprises an aqueous composition including surface enhanced pulp fibers, to form a treated fibrous substrate, drying the treated fibrous substrate to form a paper product having enhanced printing characteristics.

In one aspect of the present invention the surface treatment comprises a blend of surface enhanced pulp fibers and at least one of: a starch composition; a pigmentation composition; and a surface coating formulation.

In another aspect of the invention, the applying step includes applying the surface treatment by the use of at least one of: a two-roll size press; a rod-metering size press; a blade coater; a fountain coater; a cascade coater; and a spray applicator.

In connection with the surface treatment step of the present invention, the can comprise an ethylated starch solution having between about 0.25% to 1.0%, by weight, of the surface enhanced wood pulp fiber. In this aspect of the present invention, the ethylated starch solution comprises from about 1.0% to 12%, by weight, of starch solids. In this regard, the ethylated starch solution preferably has a viscosity of about 10 to 220 centipoise.

In another aspect, the present method includes screening the surface enhanced wood pulp fibers prior to the applying step to remove relatively larger fiber fragments to enhance printing characteristics. In another aspect of the invention, during the applying step, the surface treatment is applied to the fibrous substrate to provide coverage of gaps and/or holes existing in the fibrous substrate.

In another aspect of the present invention, prior to the applying step, the surface enhanced pulp fibers are chemically reacted with a composition to enhance ink jet printing characteristics of the paper product.

In accordance with the present invention, the surface enhanced pulp fibers comprise hardwood pulp refined with an energy input of approximately 400-1,800 kilowatt-hours/ton. In this regard, the surface enhanced pulp fiber has a length-weighted average fiber length of at least about 0.3 millimeters, and an average hydrodynamic specific surface area of at least about 10 square meters per gram, wherein the number of surface enhanced pulp fibers is at least 12,000 fibers/milligram on an oven-dry basis. In another aspect of the present method, the surface enhanced pulp fiber has a length-weighted average fiber length that is at least 60% of the length-weighted average length of the fibers prior to surface enhancement by fibrillation, and an average hydrodynamic specific surface area that is at least 4 times greater than the average specific surface area of the fibers prior to fibrillation. In another aspect of the invention, the surface enhanced pulp fibers are refined with an energy input of at least about 300 kilowatt-hours/ton.

In accordance with the present invention, the resultant paper product exhibits decreased reduction (net increase) in opacity after sizing.

These and other embodiments are presented in greater detail in the detailed description which follows.

DETAILED DESCRIPTION

Figure 1:
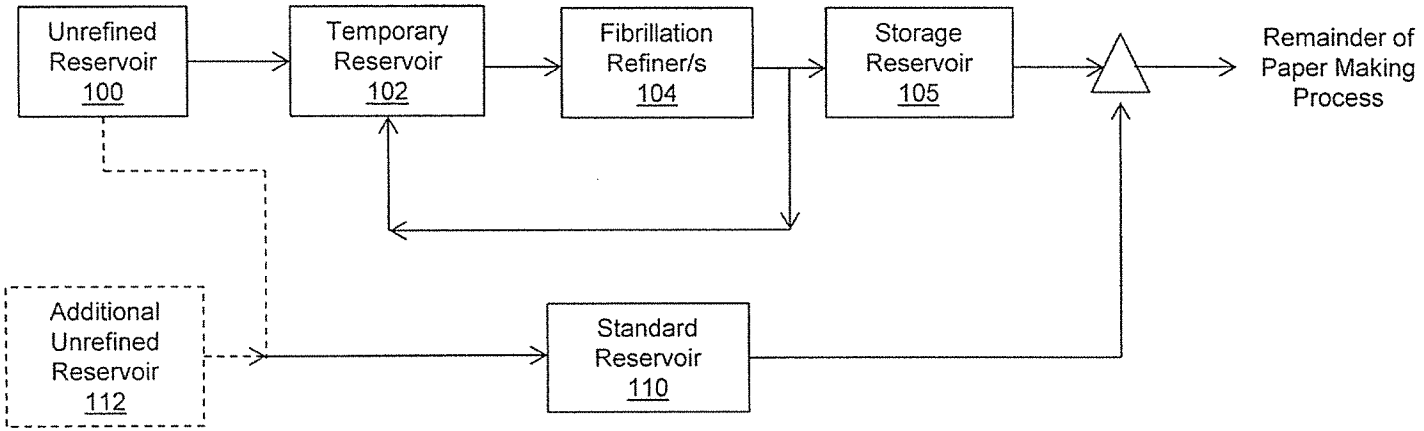
FIG. 1 is a block diagram illustrating a system for making a paper product according to one non-limiting embodiment of the present invention.

The present invention relates to a method of making a paper product having improved printing characteristics. This is achieved from a fibrous substrate, and applying a surface treatment which comprises an aqueous composition. Notably, the aqueous composition includes surface enhanced pulp fibers, with the placement of the surface enhanced pulp fibers optimizing their functionality, with surface placement by use of a paper machine size press desirably facilitating a reduction in the typical starch usage.

In accordance with the present invention, a method of making a paper product having improved printed characteristics, comprising the steps of providing a aqueous slurry comprising a blend of cellulosic fibers and water and dewatering the aqueous slurry of cellulosic fibers and water to form a fibrous substrate.

The present method further includes applying a surface treatment to the fibrous substrate, wherein the surface treatment comprises an aqueous composition including surface enhanced pulp fibers, to form a treated fibrous substrate, drying the treated fibrous substrate to form a paper product having enhanced printing characteristics.

In one aspect of the present invention the surface treatment comprises a blend of surface enhanced pulp fibers and at least one of: a starch composition; a pigmentation composition; and a surface coating formulation.

In another aspect of the invention, the applying step includes applying the surface treatment by the use of at least one of: a two-roll size press; a rod-metering size press; a blade coater; a fountain coater; a cascade coater; and a spray applicator.

In connection with the surface treatment step of the present invention, the can comprise an ethylated starch solution having between about 0.25% to 1.0%, by weight, of the surface enhanced wood pulp fiber. In this aspect of the present invention, the ethylated starch solution comprises from about 1.0% to 12%, by weight, of starch solids. In this regard, the ethylated starch solution preferably has a viscosity of about 10 to 220 centipoise.

In another aspect, the present method includes screening the surface enhanced wood pulp fibers prior to the applying step to remove relatively larger fiber fragments to enhance printing characteristics. In another aspect of the invention, during the applying step, the surface treatment is applied to the fibrous substrate to provide coverage of gaps and/or holes existing in the fibrous substrate.

In another aspect of the present invention, prior to the applying step, the surface enhanced pulp fibers are chemically reacted with a composition to enhance ink jet printing characteristics of the paper product.

In accordance with the present invention, the surface enhanced pulp fibers comprise hardwood pulp refined with an energy input of approximately 400-1,800 kilowatt-hours/ton. In this regard, the surface enhanced pulp fiber has a length-weighted average fiber length of at least about 0.3 millimeters, and an average hydrodynamic specific surface area of at least about 10 square meters per gram, wherein the number of surface enhanced pulp fibers is at least 12,000 fibers/milligram on an oven-dry basis. In another aspect of the present method, the surface enhanced pulp fiber has a length-weighted average fiber length that is at least 60% of the length-weighted average length of the fibers prior to surface enhancement by fibrillation, and an average hydrodynamic specific surface area that is at least 4 times greater than the average specific surface area of the fibers prior to fibrillation. In another aspect of the invention, the surface enhanced pulp fibers are refined with an energy input of at least about 300 kilowatt-hours/ton.

In accordance with the present invention, the resultant paper product exhibits decreased reduction (net increase) in opacity after sizing.

The embodiments can involve various applications in the following areas:

- type and properties of surface enhanced pulp fiber or modified surface enhanced pulp fibers
- aqueous solutions of surface enhanced pulp fibers including but not limited to starch, pigments, and coating formulations
- surface application equipment including but not limited to: pilot-scale equipment, two-roll size press, rod-metering size press, blade coater, fountain coater, cascade coater, and spray applicator In one embodiment at the pilot-scale, surface enhanced pulp fiber were added to an initial 10% ethylated starch solution in the amounts of 0.25% by weight, 0.5% and 1%. The starch solids were reduced by the attendant amount as the surface enhanced pulp fibers were added. The solution was applied to the paper surface using a puddle two-roll size press. Successful offset printing suggested the surface enhanced pulp fibers resulted in an enhanced surface strength with reduced starch levels.

In a similar embodiment at the pilot scale, surface enhanced pulp fibers in amounts of 0.5% to 1% were added to an ethylated starch solution in the starch solids range of 1% to 12% and a viscosity range of ~10-220 cps and applied to the paper surface using a two-roll puddle size press.

In a possible embodiment, the surface enhanced pulp fibers are screened before surface application to remove larger fiber fragments in order to enhance size press runnability.

In another embodiment, surface enhanced pulp fibers are applied to the paper surface in order to provide coverage of gaps and holes in the paper surface fiber structure. This more complete fiber coverage can lead to less offset print mottle and an improvement in print quality.

In another possible embodiment, surface enhanced pulp fibers are reacted with appropriate chemistry designed to enhance ink jet print quality. The reacted fibers are then applied in a solution to the paper surface. As the fibers remain at the surface, ink jet print quality is maximized.

Notably, it has been found that SEPF can desirably function as a sizing agent, acting to close up the surface of an associated substrate, such as fabric or paper formed from cellulosic material. SEPF can be effectively employed in a wide variety of applications, including use with both organic and inorganic materials.

Several embodiments of the present invention to create a fibrous substrate have been evaluated encompassing a range of cellulosic fiber-based furnishes. These have included: 1) utilization of both Southern and Northern hardwood and softwood furnishes, 2) a range of hardwood/softwood pulp fiber ratios, including 100% hardwood, 3) varying degrees of fiber development refining on the separate fiber furnish components, 4) inclusion of up to 10% by fiber weight of surface enhanced pulp fibers and 5) inclusion in the furnish of precipitated calcium carbonate (PCC) filler.

Fibrous substrate characteristics such as strength, porosity (related to "tightness" of the sheet structure), offset pick resistance and surface pore size distribution can be manipulated to satisfy specify specific requirements by adjusting the fore-mentioned factors.

Surface enhanced pulp fibers have been made and utilized from 1) Northern hardwood kraft, 2) Southern hardwood kraft, 3) Northern hardwood sulfite, and 4) Northern softwood kraft refined with an energy input ranging from 400-1800 kilowatt-hours/ton.

Embodiments of the present invention have been evaluated using a blend 1) of surface enhanced pulp fibers with an ethylated starch, 2) of surface enhanced pulp fibers with an ethylated starch/ground calcium carbonate (GCC) mixture and 3) of surface enhanced pulp fibers with an ethylated starch wherein the whole formulation was treated with a proprietary starch encapsulation fixative enhancement.

Several embodiments have been evaluated using 0.25%, 0.5%, 0.75% to 1% by weight of said surface enhanced pulp fibers. In accordance with claim 5, several embodiments have been evaluated using a range of starch solutions from 4% to 12%, by weight, of starch solids. Water only (0% starch) has also been evaluated. Surface enhanced pulp fiber/starch solutions ranging from 20 to >1000 centipoise have been evaluated. Numerous size press formulations stated above have been applied to the fibrous basesheet surface using a two-roll size press.

A specific embodiment of the invention entails production of a 50 #/3300 square ft offset-type sheet, to which was applied a 7% starch/0.5% surface enhanced fiber solution on the surface. The resultant product showed a greater than 2 points opacity increase, compared to a 10% starch solution applied to the same sheet. This represents a significant opacity increase which is very difficult to obtain by other means. The opacity increase arises from a lower starch level being applied where the starch is known to decrease the opacity level.

Application of surface enhanced pulp fibers does appear to cover the holes and gaps on the sheet surface in proportion to the amount applied to the surface as evidenced by surface scanning electron photomicrographs. Coverage can be enhanced by adjusting the basic process steps to yield a fibrous basesheet with a smaller surface pore size distribution. A combination of optimized fibrous basesheet and starch/surface enhanced pulp fibers solution applied at the surface can result in a paper with superior print quality.

In one embodiment, a size press formulation of 7% starch/0.5% surface enhanced fiber was applied to a fibrous substrate surface at ~47 #/t pickup. This embodiment showed similar offset print quality and surface pick strength to the 12% starch only control.

A desirable aspect of the present invention relates to a method of making a paper product wherein the product is made using a lower level of starch applied at the size press which results in a higher measured sheet opacity. Opacity is usually highly correlated to the efficiency of light scattering by the materials comprising the sheet, primarily the fiber structure and pigment filler. High light scattering efficiency will be achieved if there is a high incidence of spaces within the paper, micro gaps between fibers and fibers and filler.

In rough terms, for the highest light scattering, it is desirable that to achieve the greatest number of interfaces or micro-gaps between solid and air. As starch applied at the size press infuses the paper, it fills in the micro gaps and significantly reduces the scattering potential and thus lowers the opacity. This effect is lessened by the application of a lower level of starch, thus resulting in a higher measured opacity.

As shown in the table below, one set of embodiments comprising a 50 #/3300 sq ft offset-type sheet made from 80% hardwood/20% softwood/no filler resulted in the following measured opacity levels:

| Condition | Size press starch solids | % surface enhanced pulp fiber | Pickup (#/T) | Tappi opacity | Opacity change from control |
|---|---|---|---|---|---|
| Condition 8 - control | ~12% | | ~76 #/t | 70.2 | |
| Condition 9 | ~7% | | ~44 #/t | 73.2 | +3.0 |
| Condition 12 | ~7% | ~0.5% | ~47 #/t | 73.6 | +3.4 |

The starch-only control condition 8 had a measured opacity of 70.2. Reducing the starch pickup level in condition 9 resulted in a 3 point opacity increase. But this condition would likely not have sufficient offset pick strength. Of particular interest is condition 12, where 0.5% of surface enhanced pulp fiber was added to the reduced solids starch. In this embodiment, the surface strength should be improved and the opacity was 3.4 points higher than the control. This is a significant increase.

Another aspect of the present invention relates to improved offset picking performance. A size press formulation of 7% starch/0.5% surface enhanced pulp fiber was applied to a fibrous substrate at ~47 #/ton pickup. This embodiment showed similar offset print quality and surface offset press pick strength to the 12% starch only control at ~76 #/t pickup. One measure of surface strength is to count print picks/voids after printing on a 4-color offset press. To successfully reduce starch pickup, starch plus surface enhanced pulp fiber must maintain the surface pick strength of the full strength starch-only control.

One factor which must be addressed in connection with the application of more SEPF to the surface is the higher viscosity imparted primarily by the SEPF. It is believed that a number of steps can be taken to mitigate this effect, including using a lower viscosity starch. It is generally assumed that much of the SEPF viscosity effect is due to the water-holding capability of the SEPF from the high degree of fiber fibrillation.

Thus far, the SEPF used at the size press has been made with a higher level of power in an attempt to minimize the number of remaining long fibers which may cause fractionation. However, it is believed that this also increases the water-holding capacity of the SEPF. Accordingly, it has been considered that fractionation could be discounted, and that an SEPF made with lower power be employed. It is believed that this may allow for a higher addition level of SEPF.

It has further been considered that the starch/SEPF mixture appears to be exhibit shear thinning. Consideration has been made of developing a technique to apply the mixture under more shear or allow more SEPF to be added to the starch.

In the context of the present invention, a particularly desirable goal has been to achieve a reduction in size press starch usage. It is believed that his effect can be optimized, such as by the use of a Northern fiber basesheet using on the order 90% Northern hardwood/10% Northern softwood/7.5% hardwood SEPF/15% PCC, with moderate refining on the hardwood and softwood to produce a basesheet with good strength and a smaller surface pore size distribution.

It is believed that the wet-end added SEPF will provide some surface coverage. It is expected that such a basesheet would require less SEPF applied at the surface to further cover gaps and holes. It is further believed that application of a starch/0.75% to 1.0% SEPF to the surface would then be additive to this effect. More complete coverage of the surface gaps and holes is expected to result in improved print quality. In test trial employing Southern Softwood pulps, a somewhat higher level of refining was performed on the basesheet hardwood and softwood. The resulting basesheet was stronger and tighter and even with no starch applied to the surface showed no picking on the offset press.

Embodiments of the present invention relate generally to surface enhanced pulp fibers, methods for producing, applying, and delivering surface enhanced pulp, products incorporating surface enhanced pulp fibers, and methods for producing, applying, and delivering products incorporating surface enhanced pulp fibers, and others as will be evident from the following description. The surface enhanced pulp fibers are fibrillated to an extent that provides desirable properties as set forth below and may be characterized as being highly fibrillated. In various embodiments, surface enhanced pulp fibers of the present invention have significantly higher surface areas without significant reductions in fiber lengths, as compared to conventional refined fibers, and without a substantial amount of fines being generated during fibrillation. Such surface enhanced pulp fibers can be useful in the production of pulp, paper, and other products as described herein.

The pulp fibers that can be surface enhanced according to embodiments of the present invention can originate from a variety of wood types, including hardwood and softwood. Non-limiting examples of hardwood pulp fibers that can be used in some embodiments of the present invention include, without limitation, oak, gum, maple, poplar, eucalyptus, aspen, birch, and others known to those of skill in the art. Non-limiting examples of softwood pulp fibers that can be used in some embodiments of the present invention include, without limitation, spruce, pine, fir, hemlock, southern pine, redwood, and others known to those of skill in the art. The pulp fibers may be obtained from a chemical source (e.g., a Kraft process, a sulfite process, a soda pulping process, etc.), a mechanical source, (e.g., a thermomechanical process (TMP), a bleached chemi-thermomechanical process (BCTMP), etc.), or combinations thereof. The pulp fibers can also originate from non-wood fibers such as linen, cotton, bagasse, hemp, straw, kenaf, etc. The pulp fibers can be bleached, partially bleached, or unbleached with varying degrees of lignin content and other impurities. In some embodiments, the pulp fibers can be recycled fibers or post-consumer fibers.

Surface enhanced pulp fibers according to various embodiments of the present invention can be characterized according to various properties and combinations of properties including, for example, length, specific surface area, change in length, change in specific surface area, surface properties (e.g., surface activity, surface energy, etc.), percentage of fines, drainage properties (e.g., Schopper-Riegler), crill measurement (fibrillation), water absorption properties (e.g., water retention value, wicking rate, etc.), and various combinations thereof. While the following description may not specifically identify each of the various combinations of properties, it should be understood that different embodiments of surface enhanced pulp fibers may possess one, more than one, or all of the properties described herein.

Some embodiments of the present invention relate to a plurality of surface enhanced pulp fibers. In some embodiments, the plurality of surface enhanced pulp fibers have a length weighted average fiber length of at least about 0.2 millimeters, preferably at least about 0.25 millimeters, with a length of about 0.3 millimeters being most preferred, wherein the number of surface enhanced pulp fibers is at least 12,000/milligram on an oven-dry basis. As used herein, "oven-dry basis" means that the sample is dried in an oven set at 105.degree. C. for 24 hours. In general, the longer the length of the fibers, the greater the strength of the fibers and the resulting product incorporating such fibers. Surface enhanced pulp fibers of such embodiments can be useful, for example, in papermaking applications. As used herein, length weighted average length is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer. As used herein, length weighted average length (L.sub.W) is calculated according to the formula:

*L*.sub.*W*=.SIGMA.*n*.sub.*iL*.sub.*i*.sup.2/.SIGMA.*n*.sub.*iL*.sub.*i* wherein i refers to the category (or bin) number (e.g., 1, 2, . . . N), n.sub.i refers to the fiber count in the i.sup.th category, and L.sub.i refers to contour length-histogram class center length in the i.sup.th category.

As noted above, one aspect of surface enhanced pulp fibers of the present invention is the preservation of the lengths of the fibers following fibrillation. In some embodiments, a plurality of surface enhanced pulp fibers can have a length weighted average length that is at least 60% of the length weighted average length of the fibers prior to fibrillation. A plurality of surface enhanced pulp fibers, according to some embodiments, can have a length weighted average length that is at least 70% of the length weighted average length of the fibers prior to fibrillation. In determining the percent length preservation, the length weighted average length of a plurality of fibers can be measured (as described above) both before and after fibrillation and the values can be compared using the following formula:

$$L.\text{sub}.W(\text{before})-L.\text{sub}.W(\text{after})/L.\text{sub}.W(\text{before})$$

Surface enhanced pulp fibers of the present invention advantageously have large hydrodynamic specific surface areas which can be useful in some applications, such as papermaking. In some embodiments, the present invention relates to a plurality of surface enhanced pulp fibers wherein the fibers have an average hydrodynamic specific surface area of at least about 10 square meters per gram, and more preferably at least about 12 square meters per gram. For illustrative purposes, a typical unrefined papermaking fiber would have a hydrodynamic specific surface area of 2 m.sup.2/g. As used herein, hydrodynamic specific surface area is measured pursuant to the procedure specified in Characterizing the drainage resistance of pulp and microfibrillar suspensions using hydrodynamic flow measurements, N. Lavrykova-Marrain and B. Ramarao, TAPPI's PaperCon 2012 Conference, available at http://www.tappi.org/Hide/Events/12PaperCon/Papers/12PAP116.aspx, which is hereby incorporated by reference.

One advantage of the present invention is that the hydrodynamic specific surface areas of the surface enhanced pulp fibers are significantly greater than that of the fibers prior to fibrillation. In some embodiments, a plurality of surface enhanced pulp fibers can have an average hydrodynamic specific surface area that is at least 4 times greater than the average specific surface area of the fibers prior to fibrillation, preferably at least 6 times greater than the average specific surface area of the fibers prior to fibrillation, and most preferably at least 8 times greater than the average specific surface area of the fibers prior to fibrillation. Surface enhanced pulp fibers of such embodiments can be useful, for example, in papermaking applications. In general, hydrodynamic specific surface area is a good indicator of surface activity, such that surface enhanced pulp fibers of the present invention, in some embodiments, can be expected to have good binding and water retention properties and can be expected to perform well in reinforcement applications.

As noted above, in some embodiments, surface enhanced pulp fibers of the present invention advantageously have increased hydrodynamic specific surface areas while preserving fiber lengths. Increasing the hydrodynamic specific surface area can have a number of advantages depending on the use including, without limitation, providing increased fiber bonding, absorbing water or other materials, retention of organics, higher surface energy, and others.

Embodiments of the present invention relate to a plurality of surface enhanced pulp fibers, wherein the plurality of surface enhanced pulp fibers have a length weighted average fiber length of at least about 0.2 millimeters and an average hydrodynamic specific surface area of at least about 10 square meters per gram, wherein the number of surface enhanced pulp fibers is at least 12,000/milligram on an oven-dry basis. A plurality of surface enhanced pulp fibers, in preferred embodiments, have a length weighted average fiber length of at least about 0.25 millimeters and an average hydrodynamic specific surface area of at least about 12 square meters per gram, wherein the number of surface enhanced pulp fibers is at least 12,000/milligram on an oven-dry basis. In a most preferred embodiment, a plurality of surface enhanced pulp fibers have a length weighted average fiber length of at least about 0.3 millimeters and an average hydrodynamic specific surface area of at least about 12 square meters per gram, wherein the number of surface enhanced pulp fibers is at least 12,000/milligram on an oven-dry basis. Surface enhanced pulp fibers of such embodiments can be useful, for example, in papermaking applications.

In the refinement of pulp fibers to provide surface enhanced pulp fibers of the present invention, some embodiments preferably minimize the generation of fines. As used herein, the term "fines" is used to refer to pulp fibers having a length of 0.2 millimeters or less. In some embodiments, surface enhanced pulp fibers have a length weighted fines value of less than 40%, more preferably less than 22%, with less than 20% being most preferred. Surface enhanced pulp fibers of such embodiments can be useful, for example, in papermaking applications. As used herein, "length weighted fines value" is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer. As used herein, the percentage of length weighted fines is calculated according to the formula:

$$\%\text{ of length weighted fines}=100.\text{times}.\text{SIGMA}.n.\text{sub}.iL\text{sub}.i/L.\text{sub}.T$$

wherein n refers to the number of fibers having a length of less than 0.2 millimeters, L.sub.i refers to the fines class midpoint length, and L.sub.T refers to total fiber length.

Surface enhanced pulp fibers of the present invention simultaneously offer the advantages of preservation of length and relatively high specific surface area without, in preferred embodiments, the detriment of the generation of a large number of fines. Further, a plurality of surface enhanced pulp fibers, according to various embodiments, can simultaneously possess one or more of the other above-referenced properties (e.g., length weighted average fiber length, change in average hydrodynamic specific surface area, and/or surface activity properties) while also having a relatively low percentage of fines. Such fibers, in some embodiments, can minimize the negative effects on drainage while also retaining or improving the strength of products in which they are incorporated.

Other advantageous properties of surface enhanced pulp fibers can be characterized when the fibers are processed into other products and will be described below following a description of methods of making the surface enhanced pulp fibers.

Embodiments of the present invention also relate to methods for producing surface enhanced pulp fibers. The refining techniques used in methods of the present invention can advantageously preserve the lengths of the fibers while likewise increasing the amount of surface area. In preferred embodiments, such methods also minimize the amount of fines, and/or improve the strength of products (e.g., tensile strength, scott bond strength, wet-web strength of a paper product) incorporating the surface enhanced pulp fibers in some embodiments.

In one embodiment, a method for producing surface enhanced pulp fibers comprises introducing unrefined pulp fibers in a mechanical refiner comprising a pair of refiner plates, wherein the plates have a bar width of 1.3 millimeters or less and a groove width of 2.5 millimeters or less, and refining the fibers until an energy consumption of at least 300 kWh/ton for the refiner is reached to produce surface enhanced pulp fibers. Persons of ordinary skill in the art are familiar with the dimensions of bar width and groove width in connection with refiner plates. To the extent additional information is sought, reference is made to Christopher J. Biermann, Handbook of Pulping and Papermaking (2d Ed. 1996) at p. 145, which is hereby incorporated by reference. The plates, in a preferred embodiment, have a bar width of 1.0 millimeters or less and a groove width of 1.6 millimeters or less, and the fibers can be refined until an energy consumption of at least 300 kWh/ton for the refiner is reached to produce surface enhanced pulp fibers. In a most preferred embodiment, the plates have a bar width of 1.0 millimeters or less and a groove width of 1.3 millimeters or less, and the fibers can be refined until an energy consumption of at least 300 kWh/ton for the refiner is reached to produce surface enhanced pulp fibers. As used herein and as understood by those of ordinary skill in the art, the references to energy consumption or refining energy herein utilize units of kWh/ton with the understanding that "/ton" or "per ton" refers to ton of pulp passing through the refiner on a dry basis. In some embodiments, the fibers are refined until an energy consumption of at least 650 kWh/ton for the refiner is reached. The plurality of fibers can be refined until they possess one or more of the properties described herein related to surface enhanced pulp fibers of the present invention. As described in more detail below, persons of skill in the art will recognize that refining energies significantly greater than 300 kWh/ton may be required for certain types of wood fibers and that the amount of refining energy needed to impart the desired properties to the pulp fibers may also vary.

In one embodiment, unrefined pulp fibers are introduced in a mechanical refiner comprising a pair of refiner plates or a series of refiners. The unrefined pulp fibers can include any of the pulp fibers described herein, such as, for example, hardwood pulp fibers or softwood pulp fibers or non-wood pulp fibers, from a variety of processes described herein (e.g., mechanical, chemical, etc.). In addition, the unrefined pulp fibers or pulp fiber source can be provided in a baled or slushed condition. For example, in one embodiment, a baled pulp fiber source can comprise between about 7 and about 11% water and between about 89 and about 93% solids. Likewise, for example, a slush supply of pulp fibers can comprise about 95% water and about 5% solids in one embodiment. In some embodiments, the pulp fiber source has not been dried on a pulp dryer.

Non-limiting examples of refiners that can be used to produce surface enhanced pulp fibers in accordance with some embodiments of the present invention include double disk refiners, conical refiners, single disk refiners, multi-disk refiners or conical and disk(s) refiners in combination. Non-limiting examples of double disk refiners include Beloit DD 3000, Beloit DD 4000 or Andritz DO refiners. Non-limiting example of a conical refiner are Sunds JC01, Sunds JC 02 and Sunds JC03 refiners.

The design of the refining plates as well as the operating conditions are important in producing some embodiments of surface enhanced pulp fibers. The bar width, groove width, and groove depth are refiner plate parameters that are used to characterize the refiner plates. In general, refining plates for use in various embodiments of the present invention can be characterized as fine grooved. Such plates can have a bar width of 1.3 millimeters or less and a groove width of 2.5 millimeters or less. Such plates, in some embodiments, can have a bar width of 1.3 millimeters or less and a groove width of 1.6 millimeters or less. In some embodiments, such plates can have a bar width of 1.0 millimeters or less and a groove width of 1.6 millimeters or less. Such plates, in some embodiments, can have a bar width of 1.0 millimeters or less and a groove width of 1.3 millimeters or less. Refining plates having a bar width of 1.0 millimeters or less and a groove width of 1.6 millimeters or less may also be referred to as ultrafine refining plates. Such plates are available under the FINEBAR® brand from Aikawa Fiber Technologies (AFT). Under the appropriate operating conditions, such fine grooved plates can increase the number of fibrils on a pulp fiber (i.e., increase the fibrillation) while preserving fiber length and minimizing the production of fines. Conventional plates (e.g., bar widths of greater than 1.3 millimeters and/or groove widths of greater than 2.0 millimeters) and/or improper operating conditions can significantly enhance fiber cutting in the pulp fibers and/or generate an undesirable level of fines.

The operating conditions of the refiner can also be important in the production of some embodiments of surface enhanced pulp fibers. In some embodiments, the surface enhanced pulp fibers can be produced by recirculating pulp fibers which were originally unrefined through the refiner(s) until an energy consumption of at least about 300 kWh/ton is reached. The surface enhanced pulp fibers can be produced by recirculating pulp fibers which were originally unrefined through the refiner(s) until an energy consumption of at least about 450 kWh/ton is reached in some embodiments. In some embodiments the fibers can be recirculated in the refiner until an energy consumption of between about 450 and about 650 kWh/ton is reached. In some embodiments, the refiner can operate at a specific edge load between about 0.1 and about 0.3 Ws/m. The refiner can operate at a specific edge load of between about 0.15 and about 0.2 Ws/m in other embodiments. In some embodiments, an energy consumption of between about 450 and about 650 kWh/ton is reached using a specific edge load of between about 0.1 Ws/m and about 0.2 Ws/m to produce the surface enhanced pulp fibers. Specific edge load (or SEL) is a term understood to those of ordinary skill in the art to refer to the quotient of net applied power divided by the product of rotating speed and edge length. SEL is used to characterize the intensity of refining and is expressed as Watt-second/meter (Ws/m).

As described in more detail below, persons of skill in the art will recognize that refining energies significantly greater than 400 kWh/ton may be required for certain types of wood fibers and that the amount of refining energy needed to impart the desired properties to the pulp fibers may also vary. For example, Southern mixed hardwood fibers (e.g., oak, gum, elm, etc.) may require refining energies of between about 450-650 kWh/ton. In contrast, Northern hardwood fibers (e.g., maple, birch, aspen, beech, etc.) may require refining energies of between about 350 and about 500 kWh/ton as Northern hardwood fibers are less coarse than Southern hardwood fibers. Similarly, Southern softwood fibers (e.g., pine) may require even greater amounts of refining energy. For example, in some embodiments, refining Southern softwood fibers according to some embodiments may be significantly higher (e.g., at least 1000 kWh/ton).

The refining energy can also be provided in a number of ways depending on the amount of refining energy to be provided in a single pass through a refiner and the number of passes desired. In some embodiments, the refiners used in some methods may operate at lower refining energies per pass (e.g., 100 kWh/ton/pass or less) such that multiple passes or multiple refiners are needed to provide the specified refining energy. For example, in some embodiments, a single refiner can operate at 50 kWh/ton/pass, and the pulp fibers can be recirculated through the refiner for a total of 9 passes to provide 450 kWh/ton of refining. In some embodiments, multiple refiners can be provided in series to impart of refining energy.

In some embodiments where pulp fibers reach the desired refining energy by recirculating the fibers through a single refiner, the pulp fibers can be circulated at least two times through the refiner to obtain the desired degree of fibrillation. In some embodiments, the pulp fibers can be circulated between about 6 and about 25 times through the refiner to obtain the desired degree of fibrillation. The pulp fibers can be fibrillated in a single refiner by recirculation in a batch process.

In some embodiments, the pulp fibers can be fibrillated in a single refiner using a continuous process. For example, such a method can comprise, in some embodiments, continuously removing a plurality of fibers from the refiner, wherein a portion of the removed fibers are surface enhanced pulp fibers, and recirculating greater than about 80% of the removed fibers back to the mechanical refiner for further refining In some embodiments, greater than about 90% of the removed fibers can be recirculated back to the mechanical refiner for further refining. In such embodiments, the amount of unrefined fibers introduced to the refiner and the amount of fibers removed from the fiber without recirculation can be controlled such that a predetermined amount of fibers continually pass through the refiner. Put another way, because some amount of fibers are removed from the recirculation loop associated with the refiner, a corresponding amount of unrefined fibers should be added to the refiner in order to maintain a desired level of fibers circulating through the refiner. To facilitate the production of surface enhanced pulp fibers having particular properties (e.g., length weighted average fiber length, hydrodynamic specific surface area, etc.), the refining intensity (i.e., specific edge load) per pass will need to be reduced during the process as the number of passes increases.

In other embodiments, two or more refiners can be arranged in series to circulate the pulp fibers to obtain the desired degree of fibrillation. It should be appreciated that a variety of multi-refiner arrangements can be used to produce surface enhanced pulp fibers according to the present invention. For example, in some embodiments, multiple refiners can be arranged in series that utilize the same refining plates and operate under the same refining parameters (e.g., refining energy per pass, specific edge load, etc.). In some such embodiments, the fibers may pass through one of the refiners only once and/or through another of the refiners multiple times.

In one exemplary embodiment, a method for producing surface enhanced pulp fibers comprises introducing unrefined pulp fibers in a first mechanical refiner comprising a pair of refiner plates, wherein the plates have a bar width of 1.3 millimeters or less and a groove width of 2.5 millimeters or less, refining the fibers in the first mechanical refiner, transporting the fibers to at least one additional mechanical refiner comprising a pair of refiner plates, wherein the plates have a bar width of 1.3 millimeters or less and a groove width of 2.5 millimeters or less, and refining the fibers in the at least one additional mechanical refiner until a total energy consumption of at least 300 kWh/ton for the refiners is reached to produce surface enhanced pulp fibers. In some embodiments, the fibers can be recirculated through the first mechanical refiner a plurality of times. The fibers can be recirculated through an additional mechanical refiner a plurality of times in some embodiments. In some embodiments, the fibers can be recirculated through two or more of the mechanical refiners a plurality of times.

In some embodiments of methods for producing surface enhanced pulp fibers utilizing a plurality of refiners, a first mechanical refiner can be used to provide a relatively less fine, initial refining step and one or more subsequent refiners can be used to provide surface enhanced pulp fibers according to the embodiments of the present invention. For example, the first mechanical refiner in such embodiments can utilize conventional refining plates (e.g., bar width of greater than 1.0 mm and groove width of 1.6 mm or greater) and operate under conventional refining conditions (e.g., specific edge load of 0.25 Ws/m) to provide an initial, relatively less fine fibrillation to the fibers. In one embodiment, the amount of refining energy applied in the first mechanical refiner can be about 100 kWh/ton or less. After the first mechanical refiner, the fibers can then be provided to one or more subsequent refiners that utilizing ultrafine refining plates (e.g., bar width of 1.0 mm or less and groove width of 1.6 mm or less) and operate under conditions (e.g., specific edge load of 0.13 Ws/m) sufficient to produce surface enhanced pulp fibers in accordance with some embodiments of the present invention. In some embodiments, for example, the cutting edge length (CEL) can increase between refinement using conventional refining plates and refinement using ultrafine refining plates depending on the differences between the refining plates. Cutting Edge Length (or CEL) is the product of bar edge length and the rotational speed As set forth above, the fibers can pass through or recirculate through the refiners multiple times to achieve the desired refining energy and/or multiple refiners can be used to achieve the desired refining energy.

In one exemplary embodiment, a method for producing surface enhanced pulp fibers comprises introducing unrefined pulp fibers in a first mechanical refiner comprising a pair of refiner plates, wherein the plates have a bar width of greater than 1.0 millimeters and a groove width of 2.0 millimeters or greater. Refining the fibers in the first mechanical refiner can be used to provide a relatively less fine, initial refining to the fibers in some embodiments. After refining the fibers in the first mechanical refiner, the fibers are transported to at least one additional mechanical refiner comprising a pair of refiner plates, wherein the plates have a bar width of 1.0 millimeters or less and a groove width of 1.6 millimeters or less. In the one or more additional mechanical refiners, the fibers can be refined until a total energy consumption of at least 300 kWh/ton for the refiners is reached to produce surface enhanced pulp fibers. In some embodiments, the fibers are recirculated through the first mechanical refiner a plurality of times. The fibers are recirculated through the one or more additional mechanical refiner a plurality of times, in some embodiments.

With regard to the various methods described herein, the pulp fibers can be refined at low consistency (e.g., between 3 and 5%) in some embodiments. Persons of ordinary skill in the art will understand consistency to reference the ratio of oven dried fibers to the combined amount of oven dried fibers and water. In other words, a consistency of 3% would reflect for example, the presence of 3 grams of oven dried fibers in 100 milliliters of pulp suspension.

Other parameters associated with operating refiners to produce surface enhanced pulp fibers can readily be determined using techniques known to those of skill in the art. Similarly, persons of ordinary skill in the art can adjust the various parameters (e.g., total refining energy, refining energy per pass, number of passes, number and type of refiners, specific edge load, etc.) to produce surface enhanced pulp fibers of the present invention. For example, the refining intensity, or refining energy applied to the fibers per pass utilizing a multi-pass system, should be gradually reduced as the number of passes through a refiner increases in order to get surface enhanced pulp fibers having desirable properties in some embodiments.

Various embodiments of surface enhanced pulp fibers of the present invention can be incorporated into a variety of end products. Some embodiments of surface enhanced pulp fibers of the present invention can impart favorable properties on the end products in which they are incorporated in some embodiments. Non-limiting examples of such products include pulp, paper, paperboard, biofiber composites (e.g., fiber cement board, fiber reinforced plastics, etc.), absorbent products (e.g., fluff pulp, hydrogels, etc.), specialty chemicals derived from cellulose (e.g., cellulose acetate, carboxymethyl cellulose (CMC), etc.), and other products. Persons of skill in the art can identify other products in which the surface enhanced pulp fibers might be incorporated based particularly on the properties of the fibers. For example, by increasing the specific surface areas of surface enhanced pulp fibers (and thereby the surface activity), utilization of surface enhanced pulp fibers can advantageously increase the strength properties (e.g., dry tensile strength) of some end products while using approximately the same amount of total fibers and/or provide comparable strength properties in an end product while utilizing fewer fibers on a weight basis in the end product in some embodiments.

In addition to physical properties which are discussed further below, the use of surface enhanced pulp fibers according to some embodiments of the present invention can have certain manufacturing advantages and/or cost savings in certain applications. For example, in some embodiments, incorporating a plurality of surface enhanced pulp fibers according to the present invention into a paper product can lower the total cost of fibers in the furnish (i.e., by substituting high cost fibers with lower cost surface enhanced pulp fibers). For example, longer softwood fibers typically cost more than shorter hardwood fibers. In some embodiments, a paper product incorporating at least 2 weight percent surface enhanced pulp fibers according to the present invention can result in the removal of about 5% of the higher cost softwood fibers while still maintaining the paper strength, maintaining runnability of the paper machine, maintaining process performance, and improving print performance. A paper product incorporating between about 2 and about 8 weight percent surface enhanced pulp fibers according to some embodiments of the present invention can result in removal of about 5% and about 20% of the higher cost softwood fibers while maintaining the paper strength and improving print performance in some embodiments. Incorporating between about 2 and about 8 weight percent surface enhanced pulp fibers according to the present invention can help lower the cost of manufacturing paper significantly when compared to a paper product made in the same manner with substantially no surface enhanced pulp fibers in some embodiments.

One application in which surface enhanced pulp fibers of the present invention can be used, is paper products. In the production of paper products using surface enhanced pulp fibers of the present invention, the amount of surface enhanced pulp fibers used in the production of the papers can be important. For example, and without limitation, using some amount of surface enhanced pulp fibers can have the advantages of increasing the tensile strength and/or increasing the wet web strength of the paper product, while minimizing potential adverse effects such as drainage. In some embodiments, a paper product can comprise greater than about 2 weight percent surface enhanced pulp fibers (based on the total weight of the paper product). A paper product can comprise greater than about 4 weight percent surface enhanced pulp fibers in some embodiments. A paper product, in some embodiments, can comprise less than about 15 weight percent surface enhanced pulp fibers. In some embodiments, a paper product can comprise less than about 10 weight percent surface enhanced pulp fibers. A paper product can comprise between about 2 and about 15 weight percent surface enhanced pulp fibers in some embodiments. In some embodiments, a paper product can comprise between about 4 and about 10 weight percent surface enhanced pulp fibers. In some embodiments, the surface enhanced pulp fibers used in paper products can substantially or entirely comprise hardwood pulp fibers.

In some embodiments, when surface enhanced pulp fibers of the present invention are incorporated into paper products, the relative amount of softwood fibers that can be displaced is between about 1 and about 2.5 times the amount of surface enhanced pulp fibers used (based on the total weight of the paper product), with the balance of the substitution coming from conventionally refined hardwood fibers. In other words, and as one non-limiting example, about 10 weight percent of the conventionally refined softwood fibers can be replaced by about 5 weight percent surface enhanced pulp fibers (assuming a displacement of 2 weight percent of softwood fibers per 1 weight percent of surface enhanced pulp fibers) and about 5 weight percent conventionally refined hardwood fibers. Such substitution can occur, in some embodiments, without compromising the physical properties of the paper products.

With regard to physical properties, surface enhanced pulp fibers according to some embodiments of the present invention can improve the strength of a paper product. For example, incorporating a plurality of surface enhanced pulp fibers according to some embodiments of the present invention into a paper product can improve the strength of the final product. In some embodiments, a paper product incorporating at least 5 weight percent surface enhanced pulp fibers according to the present invention can result in higher wet-web strength and/or dry strength characteristics, can improve runnability of a paper machine at higher speeds, and/or can improve process performance, while also improving production. Incorporating between about 2 and about 10 weight percent surface enhanced pulp fibers according to the present invention can help improve the strength and performance of a paper product significantly when compared to a similar product made in the same manner with substantially no surface enhanced pulp fibers according to the present invention, in some embodiments.

As another example, a paper product incorporating between about 2 and about 8 weight percent surface enhanced pulp fibers according to some embodiments of the present invention, and with about 5 to about 20 weight percent less softwood fibers, can have similar wet web tensile strength to a similar paper product with the softwood fibers and without surface enhanced pulp fibers. A paper product incorporating a plurality of surface enhanced pulp fibers according to the present invention can have a wet web tensile strength of at least 150 meters in some embodiments. In some embodiments, a paper product incorporating at least 5 weight percent surface enhanced pulp fibers, and 10% weight less softwood fibers, according to some embodiments of the present invention, can have a wet web tensile strength (at 30% consistency) of at least 166 meters. Incorporating between about 2 and about 8 weight percent surface enhanced pulp fibers according to the present invention can improve wet web tensile strength of a paper product when compared to a paper product made in the same manner with substantially no surface enhanced pulp fibers, such that some embodiments of paper products incorporating surface enhanced pulp fibers can have desirable wet-web tensile strengths with fewer softwood fibers. In some embodiments, incorporating at least about 2 weight percent surface enhanced pulp fibers of the present invention in a paper product can improve other properties in various embodiments including, without limitation, opacity, porosity, absorbency, tensile energy absorption, scott bond/internal bond and/or print properties (e.g., ink density print mottle, gloss mottle).

As another example, in some embodiments, a paper product incorporating a plurality surface enhanced pulp fibers according to the present invention can have a desirable dry tensile strength. In some embodiments, a paper product incorporating at least 5 weight percent surface enhanced pulp fibers can have a desirable dry tensile strength. A paper product incorporating between about 5 and about 15 weight percent surface enhanced pulp fibers according to the present invention can have a desirable dry tensile strength. In some embodiments, incorporating between about 5 and about 15 weight percent surface enhanced pulp fibers according to the present invention can improve dry tensile strength of a paper product when compared to a paper product made in the same manner with substantially no surface enhanced pulp fibers.

In some embodiments, incorporating at least about 5 weight percent surface enhanced pulp fibers of the present invention can improve other properties in various embodiments including, without limitation, opacity, porosity, absorbency, and/or print properties (e.g., ink density print mottle, gloss mottle, etc.).

In some embodiments of such products incorporating a plurality of surface enhanced pulp fibers, the improvements of certain properties, in some instances, can be proportionally greater than the amount of surface enhanced pulp fibers included. In other words, and as an example, in some embodiments, if a paper product incorporates about 5 weight percent surface enhanced pulp fibers, the corresponding increase in dry tensile strength may be significantly greater than 5%.

In addition to paper products which have been discussed above, in some embodiments, pulp incorporating a plurality of surface enhanced pulp fibers according to the present invention can have improved properties such as, without limitation, improved surface activity or reinforcement potential, higher sheet tensile strength (i.e., improved paper strength) with less total refining energy, improved water absorbency, and/or others.

As another example, in some embodiments, an intermediate pulp and paper product (e.g., fluff pulp, reinforcement pulp for paper grades, market pulp for tissue, market pulp for paper grades, etc.), incorporating between about 1 and about 10 weight percent surface enhanced pulp fibers can provide improved properties. Non-limiting examples of improved properties of intermediate pulp and paper products can include increased wet web tensile strength, a comparable wet web tensile strength, improved absorbency, and/or others.

As another example, in some embodiments, an intermediate paper product (e.g., baled pulp sheets or rolls, etc.), incorporating surface enhanced pulp fibers can provide a disproportionate improvement in final product performance and properties, with at least 1 weight percent surface enhanced pulp fibers being more preferred. In some embodiments, an intermediate paper product can incorporate between 1 weight percent and 10 weight percent surface enhanced pulp fibers. Non-limiting examples of improved properties of such intermediate paper products can include, increased wet web tensile strength, better drainage properties at comparable wet web tensile strength, improved strength at a similar hardwood to softwood ratio, and/or comparable strength at higher hardwood to softwood ratio.

In manufacturing paper products according to some embodiments of the present invention, surface enhanced pulp fibers of the present invention can be provided as a slipstream in a conventional paper manufacturing process. For example, surface enhanced pulp fibers of the present invention can be mixed with a stream of hardwood fibers refined using conventional refining plates and under conventional conditions. The combination stream of hardwood pulp fibers can then be combined with softwood pulp fibers and used to produce paper using conventional techniques.

Other embodiments of the present invention relate to paperboards that comprise a plurality of surface enhanced pulp fibers according to some embodiments of the present invention. Paperboards according to embodiments of the present invention can be manufactured using techniques known to those of skill in the art except incorporating some amount of surface enhanced pulp fibers of the present invention, with at least 2% surface enhanced pulp fibers being more preferred. In some embodiments, paperboards can be manufactured using techniques known to those of skill in the art except utilizing between about 2% and about 3% surface enhanced pulp fibers of the present invention.

Other embodiments of the present invention also relate to bio fiber composites (e.g., fiber cement boards, fiber reinforced plastics, etc.) that includes a plurality of surface enhanced pulp fibers according to some embodiments of the present invention. Fiber cement boards of the present invention can generally be manufactured using techniques known to those of skill in the art except incorporating surface enhanced pulp fibers according to some embodiments of the present invention, at least 3% surface enhanced pulp fibers being more preferred. In some embodiments, fiber cement boards of the present invention can generally be manufactured using techniques known to those of skill in the art except utilizing between about 3% and about 5% surface enhanced pulp fibers of the present invention.

Other embodiments of the present invention also relate to water absorbent materials that comprise a plurality of surface enhanced pulp fibers according to some embodiments of the present invention. Such water absorbent materials can be manufactured using techniques known to those of skill in the art utilizing surface enhanced pulp fibers according to some embodiments of the present invention. Non-limiting examples of such water absorbent materials include, without limitation, fluff pulps and tissue grade pulps.

FIG. 1 illustrates one exemplary embodiment of a system that can be used to make paper products incorporating surface enhanced pulp fibers of the present invention. An unrefined reservoir 100 containing unrefined hardwood fibers, for example in the form of a pulp base, is connected to a temporary reservoir 102, which is connected to a fibrillation refiner 104 in a selective closed circuit connection. As mentioned above, in a particular embodiment, the fibrillation refiner 104 is a refiner that is set up with suitable parameters to produce the surface enhanced pulp fibers described herein. For example, the fibrillation refiner 104 can be a dual disk refiner with pair of refining disks each having a bar width of 1.0 millimeters and a groove width of 1.3 millimeters, and with a specific edge load of about 0.1-0.3 Ws/m. The closed circuit between the temporary reservoir 102 and fibrillation refiner 104 is maintained until the fibers have circulated through the refiner 104 a desired number of times, for example until an energy consumption of about 400-650 kWh/ton is reached.

An exit line extends from the fibrillation refiner 104 to a storage reservoir 105, this line remaining closed until the fibers have circulated through the refiner 104 an adequate number of times. The storage reservoir 105 is in connection with a flow exiting from a conventional refiner 110 set up with conventional parameters to produce conventional refined fibers. In some embodiments, the storage reservoir 105 is not utilized and the fibrillation refiner 104 is in connection with the flow exiting from the conventional refiner 110.

In a particular embodiment, the conventional refiner 110 is also connected to the unrefined reservoir 100, such that a single source of unrefined fibers (e.g., a single source of hardwood fibers) is used in both the refining and fibrillation processes. In another embodiment, a different unrefined reservoir 112 is connected to the conventional refiner 110 to provide the conventional refined fibers. In this case, both reservoirs 100, 112 can include similar or different fibers therein.

It is understood that all the connections between the different elements of the system may include pumps (not shown) or other suitable equipment for forcing the flow therebetween as required, in addition to valves (not shown) or other suitable equipment for selectively closing the connection where required. Also, additional reservoirs (not shown) may be located in between successive elements of the system.

In use and in accordance with a particular embodiment, the unrefined fibers are introduced in a mechanical refining process where a relatively low specified edge load (SEL), for example about 0.1-0.3 Ws/m, is applied thereon, for example through the refining plates described above. In the embodiment shown, this is done by circulating the unrefined fibers from the reservoir 100 to the temporary reservoir 102, and then between the fibrillation refiner 104 and the temporary reservoir 102. The mechanical refining process is continued until a relatively high energy consumption is reached, for example about 450-650 kWh/ton. In the embodiment shown, this is done by recirculating the fibers between the fibrillation refiner 104 and temporary reservoir 102 until the fibers have gone through the refiner 104 "n" times. In one embodiment, n is at least 3, and in some embodiments may be between 6 and 25. n can be selected to provide surface enhanced pulp fibers with properties (e.g., length, length weighted average, specific surface area, fines, etc.) for example within the given ranges and/or values described herein.

The surface enhanced pulp fiber flow then exits the fibrillation refiner 104, to the storage reservoir 105. The surface enhanced pulp fiber flow exits the storage reservoir 105 and is then added to a flow of conventional refined fibers having been refined in a conventional refiner 110 to obtain a stock composition for making paper. The proportion between the surface enhanced pulp fibers and the conventional refined fibers in the stock composition may be limited by the maximum proportion of surface enhanced pulp fibers that will allow for adequate properties of the paper produced. In one embodiment, between about 4 and 15% of the fiber content of the stock composition is formed by the surface enhanced pulp fibers (i.e., between about 4 and 15% of the fibers present in the stock composition are surface enhanced pulp fibers). In some embodiments, between about 5 and about 10% of the fibers present in the stock composition are surface enhanced pulp fibers. Other proportions of surface enhanced pulp fibers are described herein and can be used.

The stock composition of refined fibers and surface enhanced pulp fibers can then be delivered to the remainder of a papermaking process where paper can be formed using techniques known to those of skill in the art.

Figure 2:
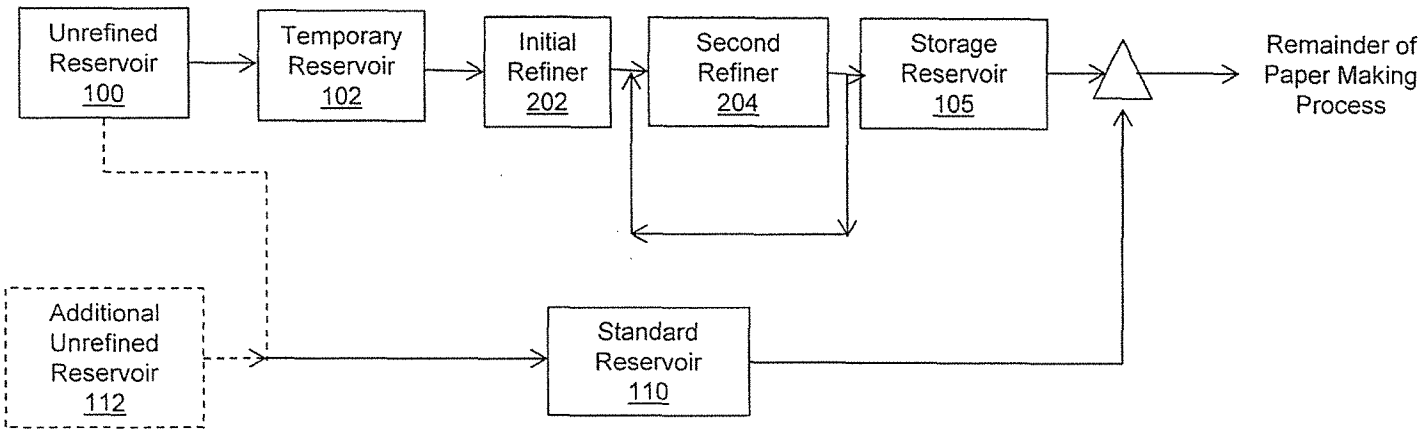
FIG. 2 is a block diagram illustrating a system for making a paper product that includes a second refiner according to one non-limiting embodiment of the present invention.

FIG. 2 illustrates a variation of the exemplary embodiment shown in FIG. 1 in which the the fibrillation refiner 104 has been replaced two refiners 202,204 arranged in series. In this embodiment, the initial refiner 202 provides a relatively less fine, initial refining step, and the second refiner 204 continues to refine the fibers to provide surface enhanced pulp fibers. As shown in FIG. 2, the fibers can be recirculated in the second refiner 204 until the fibers have circulated through the refiner 204 a desired number of times, for example until a desired energy consumption is reached. Alternatively, rather than recirculating the fibers in the second refiner 204, additional refiners may be arranged in series after the second refiner 204 to further refine the fibers, and any such refiners can include a recirculation loop if desired. While not shown in FIG. 1, depending on the energy output of the initial refiner 202, and the desired energy to be applied to the fibers in the initial refinement stage, some embodiments may include recirculation of the fibers through the initial refiner 202 prior to transport to the second refiner 204. The number of refiners, the potential use of recirculation, and other decisions related to arrangement of refiners for providing surface enhanced pulp fibers can depend on a number of factors including the amount of manufacturing space available, the cost of refiners, any refiners already owned by the manufacturer, the potential energy output of the refiners, the desired energy output of the refiners, and other factors.

In one non-limiting embodiment, the initial refiner 202 can utilize a pair of refining disks each having a bar width of 1.0 millimeters and a groove width of 2.0 millimeters. The second refiner 204 can have a pair of refining disks each having a bar width of 1.0 millimeters and a groove width of 1.3 millimeters. The fibers, in such an embodiment, can be refined in the first refiner at a specific edge load of 0.25 Ws/m until a total energy consumption of about 80 kWh/ton is reached. The fibers can then be transported to the second refiner 204 where they can be refined and recirculated at a specific edge load of 0.13 Ws/m until a total energy consumption of about 300 kWh/ton is reached.

The remaining steps and features of the system embodiment shown in FIG. 2 can be the same as those in FIG. 1.

General

Unless indicated to the contrary, the numerical parameters set forth in this specification are approximations that can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

U.S. Patent Application No. 2014/0057105, published Feb. 27, 2014, is hereby incorporated by reference.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention, as defined by the appended claims.

What is claimed is:

1. A method of making a paper product having improved printed characteristics, comprising the steps of:

providing an aqueous slurry comprising a blend of cellulosic fibers and water;

at least partially dewatering the aqueous slurry of cellulosic fibers and water to form a fibrous substrate;

applying a surface treatment to a top surface of the fibrous substrate, wherein the surface treatment comprises an aqueous composition comprising surface enhanced pulp fibers, to form a treated fibrous substrate, wherein the surface treatment is integrally coupled to the top surface of the fibrous substrate; and drying the treated fibrous substrate to form a paper product having enhanced printing characteristics, wherein the surface enhanced pulp fibers comprise refined hardwood pulp fibers having a length-weighted average fiber length of at least about 0.3 millimeters, and an average hydrodynamic specific surface area of at least about 10 square meters per gram.

2. The method of claim 1, wherein the surface treatment comprises a blend of surface enhanced pulp fibers and at least one of: a starch composition; a pigmentation composition; and a surface coating formulation.

3. The method of claim 2, wherein the surface treatment comprises an ethylated starch solution having between about 0.25% to 1.0%, by weight, of the surface enhanced wood pulp fiber.

4. The method of claim 3, wherein the ethylated starch solution comprises from about 1.0% to 12%, by weight, of starch solids.

5. The method of claim 3, wherein the ethylated starch solution comprises has a viscosity of about 10 to 220 centipoise.

6. The method of claim 2, wherein the surface treatment comprises a 7.0% ethylated starch/0.5% surface enhanced wood pulp fibers solution by weight, and wherein the paper product has a greater than 2 points opacity increase.

7. The method of claim 1, wherein the applying step comprises applying the surface treatment by the use of at least one of: a two-roll size press; a rod-metering size press; a blade coater; a fountain coater; a cascade coater; and a spray applicator.

8. The method of claim 1, further comprising screening the surface enhanced wood pulp fibers prior to the applying step to remove relatively larger fiber fragments to enhance printing characteristics.

9. The method of claim 1, wherein during the applying step, the surface treatment is applied to the fibrous substrate to provide coverage of gaps existing in the underlying fibrous substrate.

10. The method of claim 1, wherein prior to the applying step, further comprising chemically reacting the surface enhanced pulp fibers with a composition to enhance ink jet printing characteristics of the paper product.

11. The method of claim 1, further comprising refining the hardwood pulp to an energy input of approximately 400-1,800 kilowatt-hours/ton to form the surface enhanced pulp fibers.

12. The method of claim 1, wherein the number of surface enhanced pulp fibers is at least 12,000 fibers/milligram on an oven-dry basis.

13. The method of claim 1, wherein the surface enhanced pulp fiber has a length-weighted average fiber length that is at least 60% of the length-weighted average length of the fibers prior surface enhancement by fibrillation, and an average hydrodynamic specific surface area that is at least 4 times greater than the average specific surface area of the fibers prior to fibrillation.

14. The method of claim 13, wherein the surface enhanced pulp fibers are refined with an energy input of at least about 300 kilowatt-hours/ton.

15. The method of claim 1, wherein the surface enhanced pulp fibers function as a sizing agent to close up the top surface of the fibrous substrate.

16. A paper product having improved printed characteristics, comprising:

a fibrous substrate having a top surface;

a surface treatment configured to provide coverage of gaps existing in the underlying fibrous substrate, the surface treatment comprises a layer of surface enhanced pulp fibers and a starch composition comprising an ethylated starch solution having between about 0.25% to 1.0%, by weight, of the surface enhanced wood pulp fibers, wherein the surface treatment is integrally coupled to the top surface of the fibrous substrate, wherein the surface enhanced pulp fibers comprise refined hardwood pulp fibers having a length-weighted average fiber length of at least about 0.3 millimeters, and an average hydrodynamic specific surface area of at least about 10 square meters per gram.

17. The paper product of claim 16, wherein the surface treatment further comprises at least one of: a pigmentation composition; and a surface coating formulation.

18. The paper product of claim 16, wherein the ethylated starch solution comprises from about 1.0% to 12%, by weight, of starch solids, and wherein the ethylated starch solution comprises has a viscosity of about 10 to 220 centipoise.

19. The paper product of claim 16, wherein hardwood pulp is refined to an energy input of approximately 400-1, 800 kilowatt-hours/ton to form the surface enhanced pulp fibers.

20. The paper product of claim 16, wherein the number of surface enhanced pulp fibers is at least 12,000 fibers/milligram on an oven-dry basis.

21. The paper product of claim 16, wherein the surface enhanced pulp fiber has a length-weighted average fiber length that is at least 60% of the length-weighted average length of the fibers prior surface enhancement by fibrillation, and an average hydrodynamic specific surface area that is at least 4 times greater than the average specific surface area of the fibers prior to fibrillation.

22. The paper product of claim 16, wherein the surface enhanced pulp fibers function as a sizing agent to close up the top surface of the fibrous substrate.

23. The paper product of claim 16, wherein the surface treatment comprises a 7.0% ethylated starch/0.5% surface enhanced wood pulp fibers solution by weight, and wherein the paper product has a greater than 2 points opacity increase.

* * * * *